US007025689B2

(12) United States Patent
Infalt

(10) Patent No.: US 7,025,689 B2
(45) Date of Patent: Apr. 11, 2006

(54) ADJUSTABLE ATHLETIC SWING TRAINING AID

(76) Inventor: Mark Steven Infalt, 612 N. Park Ave., Indianapolis, IN (US) 46204

( * ) Notice: Subject to any disclaimer, the term of this patent is extended or adjusted under 35 U.S.C. 154(b) by 0 days.

(21) Appl. No.: 10/812,154

(22) Filed: Mar. 29, 2004

(65) Prior Publication Data

US 2005/0215341 A1 Sep. 29, 2005

(51) Int. Cl.
*A63B 69/36* (2006.01)

(52) U.S. Cl. ..... 473/257; 473/266; 473/272; 473/273

(58) Field of Classification Search ..... 473/219, 473/257, 258, 266, 271, 272, 273, 274, 275–277
See application file for complete search history.

(56) References Cited

U.S. PATENT DOCUMENTS

| | | | | |
|---|---|---|---|---|
| 2,611,610 | A * | 9/1952 | Rikuo Hara | 473/271 |
| 3,698,721 | A * | 10/1972 | Stewart | 473/264 |
| 3,740,051 | A * | 6/1973 | Cross | 473/268 |
| 4,040,633 | A | 8/1977 | Sciarrillo | |
| 4,815,743 | A | 3/1989 | Meeker et al. | |
| 4,913,419 | A * | 4/1990 | McAuliffe | 482/87 |
| 4,928,974 | A | 5/1990 | VanKirk | |
| 5,071,130 | A * | 12/1991 | Shofner | 473/218 |
| 5,303,926 | A * | 4/1994 | Owens et al. | 473/261 |
| 5,421,579 | A * | 6/1995 | Uebele, Jr. | 473/229 |
| 5,439,226 | A * | 8/1995 | Luedtke | 473/232 |
| 5,441,275 | A | 8/1995 | Yoshishita | |
| 5,595,545 | A | 1/1997 | O'Brien | |
| 5,642,880 | A * | 7/1997 | Wiseman et al. | 473/417 |
| 5,722,920 | A * | 3/1998 | Bauer | 482/83 |
| 6,165,079 | A | 12/2000 | Czaja | |
| 6,273,826 | B1 | 8/2001 | Bauer | |
| 6,322,456 | B1 | 11/2001 | Benggon | |
| 6,582,319 | B1 * | 6/2003 | Czaja | 473/257 |
| 6,805,641 | B1 * | 10/2004 | Pope | 473/274 |
| 2001/0004612 | A1 | 6/2001 | Hope et al. | |
| 2002/0082106 | A1 | 6/2002 | Czaja | |
| 2003/0176229 | A1 | 9/2003 | Schutte | |

* cited by examiner

*Primary Examiner*—Nini F. Legesse
(74) *Attorney, Agent, or Firm*—Bose McKinney & Evans LLP

(57) ABSTRACT

An adjustable swing training aid for training an athlete to perform a desired swing. The swing training aid includes an adjustable stand having a pad connector; and a swing pad having an attachment spot for attaching the swing pad to the adjustable stand. The stand adjusts to move the swing pad into a desired position. The adjustable stand can include a base, a first arm of variable length, a second arm of variable length, a first adjustable connector, and a second adjustable connector. The first arm is coupled to the base. The first connector couples the first arm and the second arm, and adjusts the angle therebetween. The second arm is rotateable about the base. The second connector couples the second arm to the swing pad and adjusts the angle therebetween. The swing pad preferably includes a plurality of attachment spots for connecting to the pad connector.

16 Claims, 11 Drawing Sheets

ADJUSTABLE ATHLETIC SWING TRAINING AID

I. TECHNICAL FIELD OF THE INVENTION

The present invention relates to sports training equipment, and in particular, to an athletic swing training aid that shows a desired swing plane and swing path for a stroking device (e.g., golf club, tennis racquet, etc.), and shows desired reference points for proper stance and positioning, while allowing an athlete to assume the desired stance and follow the desired swing path and strike a target object (e.g., golf ball, tennis ball, etc.).

II. BACKGROUND OF THE INVENTION

A variety of training devices have been suggested for use by an athlete for sports involving a stroking device, such as a golf club or tennis racquet, that is intended to swing and hit a target object, such as a golf ball or tennis ball. Many of these training devices are designed to insure that the stroking device is moved through a proper swing plane when striking the target object. Generally, these training devices have included rather elaborate systems of rails which guide the stroking device throughout all or a major portion of a stroke considered to be ideal and preset into the devices by adjustments of the rails in accordance with size of the athlete, length of the stroking object, and the like.

Some golf swing training devices include elaborate systems of PVC or similar piping forming a circle or substantial portion of the golf swing, or alternatively have tracks that the club is attached to for the desired swing. The golfer steps into the device and slides his club along the PVC piping or track to learn the desired swing. These devices are generally very large and awkward to move, and while devices may be useful for demonstrating to the golfer the desired swing path, they are not effective at insuring that the golfer executes the desired swing when the aid is no longer used. The rails or piping of such devices serve as artificial crutches to keep the club on a correct path despite the body and arm movements of the golfer during the swing. When the crutch is removed, any faults in the golfer's body and arm movements will inevitably result in defects in the swing. These devices are also limited in their adjustments to conform to the varying shapes and sizes of golfers and desired swings. Many of these devices are also not very useful for training of chipping and putting strokes which form a substantial part of the golf game.

Other golf swing training devices have also been designed for physically limiting portions of the golfer's body to certain positions during practice swings. These devices are usually extremely complex or concentrate only on a particular part of the body to the exclusion of others. In addition, like the piping and track devices discussed above, these devices form a crutch which may demonstrate the desired body position while the golfer is using the device but when the crutch is removed the undesirable body movements are likely to return. Many of these devices are also limited in their adjustments to conform to the varying shapes and sizes of golfers and desired swings. These devices are also not very useful for training of chipping and putting strokes which form a substantial part of the golf game.

Yet other golf swing training devices have been designed that utilizes complex curved surfaces to cause a particular desired swing. These devices may be useful for a particular swing, but they are not very useful for chipping, putting and other strokes which form a substantial part of the golf game.

Many of these devices are also limited in their adjustments to conform to the varying shapes and sizes of golfers and desired swings.

Many tennis swing training devices are attached to the tennis players body. These devices are used to limit the stroke of the player while wearing the device. These devices are often awkward for playing tennis, and while these devices may cause the desired stroking movement while the tennis player is wearing the device, once the device and its limitations are removed the player is likely to return to his bad habits.

Accordingly, a primary object of the present invention is to provide a swing training aid which overcome the limitations and other issues with the current state of swing training aids, and is useable to address various aspects of the swing.

III. SUMMARY OF THE INVENTION

In accordance with the present invention, a very versatile swing training aid is disclosed that promotes an athlete to learn a desired swing path and swing position using a stroking device (e.g., golf club, tennis racquet, etc.) while allowing the athlete to follow the desired swing path and swing position to strike a target object (e.g., golf ball, tennis ball, etc.). The swing training aid includes an adjustable stand that has a pad connector, and a swing pad that has a flat front surface and an attachment spot. The attachment spot connects to the pad connector to attach the swing pad to the adjustable stand. The adjustable stand can be adjusted to position the swing pad in a desired position.

One of the features of the present invention is the numerous positions the swing pad can be positioned in by adjustment of the stand. In one embodiment, the adjustable stand includes a base, a first arm having a proximal end and a distal end, and a second arm having a proximal end and a distal end. The proximal end of the first arm is coupled to the base and the distal end of the first arm is coupled to the proximal end of the second arm, and the second arm is rotateable about the base. The pad connector is attached to the second arm.

The base can include a position reference scale which the athlete can use to position their feet, or the target object, or something else relevant to the swing in a desired, repeatable location.

The adjustable stand can also include a first adjustable elbow having a first leg, a second leg and an adjustable connector connecting the first leg to the second leg. The first leg of the first adjustable elbow is connected to the distal end of the first arm, and the second leg of the first adjustable elbow is connected to the proximal end of the second arm. By adjusting the adjustable connector of the first adjustable elbow, the angle between the first arm and the second arm can be varied.

The adjustable stand can also include a second adjustable elbow having a first leg, a second leg and an adjustable connector connecting the first leg to the second leg. The pad connector of the stand is attached to the second leg of the second adjustable elbow. The first leg of the second adjustable elbow is connected to the distal end of the second arm, and the second leg of the second adjustable elbow is connected to the swing pad. By adjusting the adjustable connector of the second adjustable elbow, the angle between the second arm and the swing pad can be varied.

The adjustable stand can also include a first arm and/or a second arm that is adjustable in length. One way of designing this is to have the arm include a proximal member, a distal member and a locking mechanism. The distal member can be designed to be slideable into and out-of the proximal member to adjust the length of the arm, and the locking mechanism can be used to lock the arm at the desired length.

The swing pad can include multiple attachment spots. This will allow the swing pad to be attached to the stand at multiple positions so that the swing pad provides more reference points on the backswing or follow-through depending on what is desired.

To aid in repeatable positioning of the swing pad in the desired position, the swing pad can also include position markings surrounding each attachment spot, and the pad connector can include a reference alignment mark. When the swing pad is attached to the pad connector, the reference alignment mark of the pad connector can be aligned with the desired position markings on the swing pad to achieve the desired swing pad position relative to the adjustable stand.

The swing training aid can include features to reduce its tendency to move or tilt due to environmental conditions, such as wind. The swing pad can include several wind apertures to reduce the wind resistance caused by the swing pad. The base can be made of a heavy material, or be attachable to the ground. The base can also be designed to be thicker on the front to resist tilting.

These and other features of the present invention will become more apparent to those skilled in the art in connection with a review of the drawings and detailed description of the invention set forth below.

V. BRIEF DESCRIPTION OF THE DRAWINGS

VI. DETAILED DESCRIPTION

Figure 1:
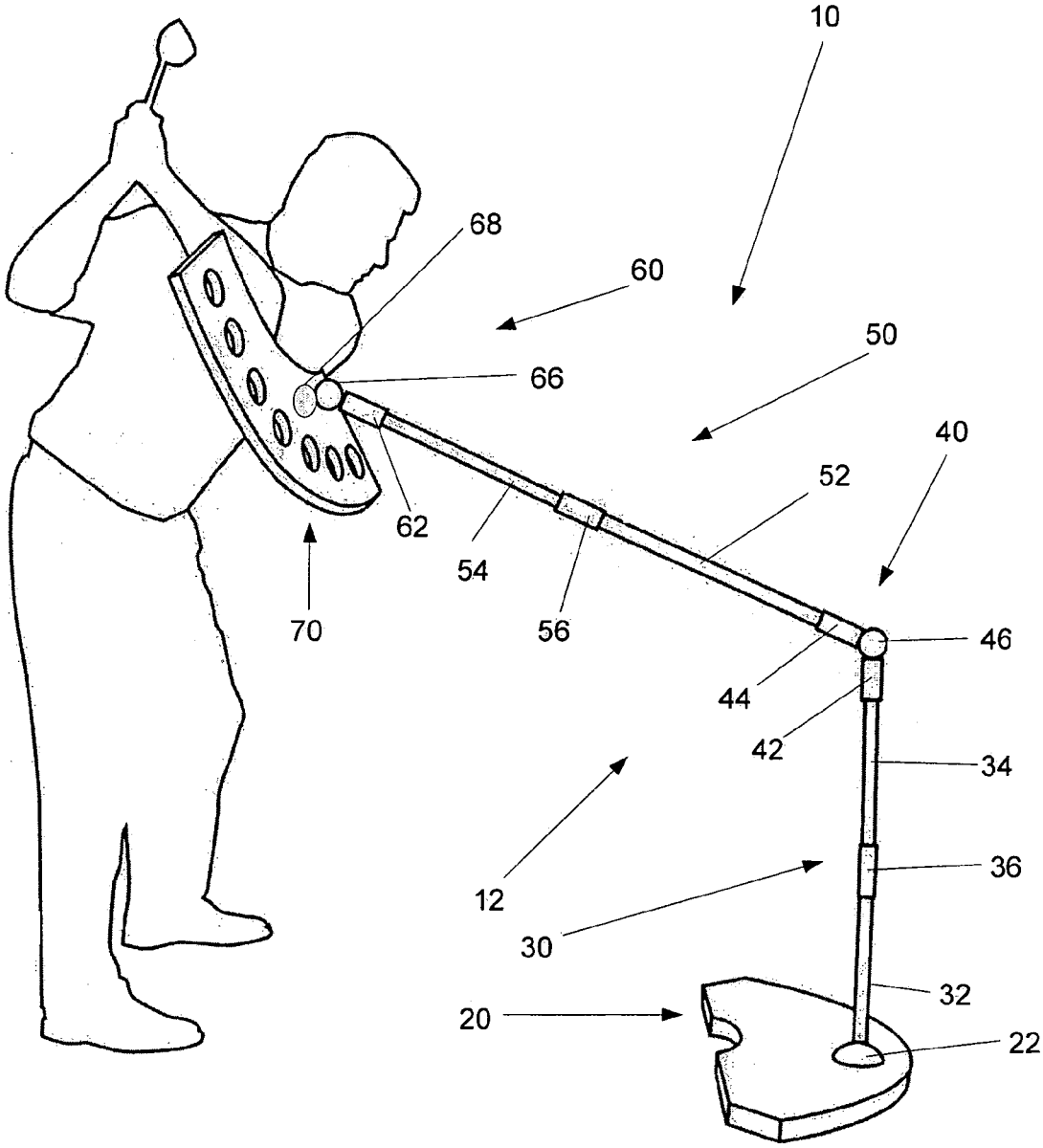
FIG. 1 is a schematic view of a swing training aid according to the present invention positioned at arm level for a right-handed golfer's full swing.

FIG. 1 shows a swing training aid 10 according to the present invention. The swing training aid 10 comprises a swing pad 70 and a stand 12 which in the preferred embodiment comprises a base 20, a first arm 30, a first adjustable elbow 40, a second arm 50, and a second adjustable elbow 60.

Figure 2:
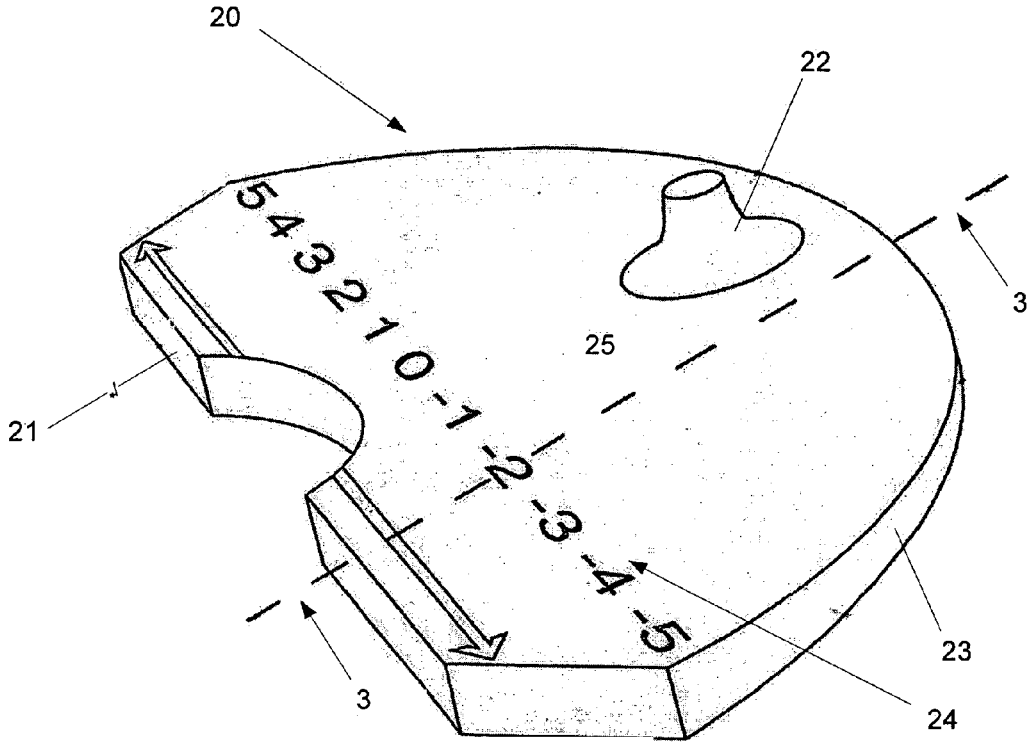
FIG. 2 is a top view of the base of the swing training aid.
Figure 3:
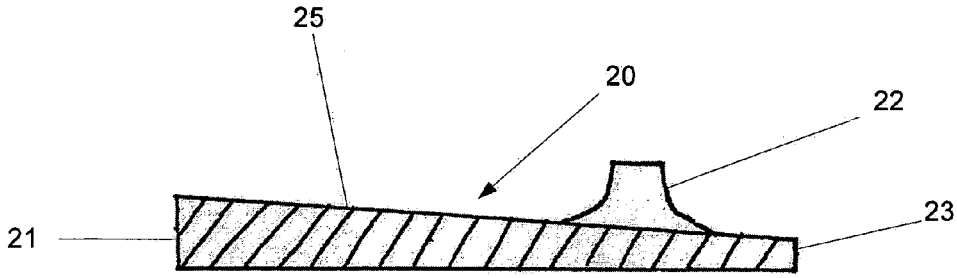
FIG. 3 is a cross-section of the base of the swing training aid taken along the line 3—3 shown in FIG. 2.
Figure 4:
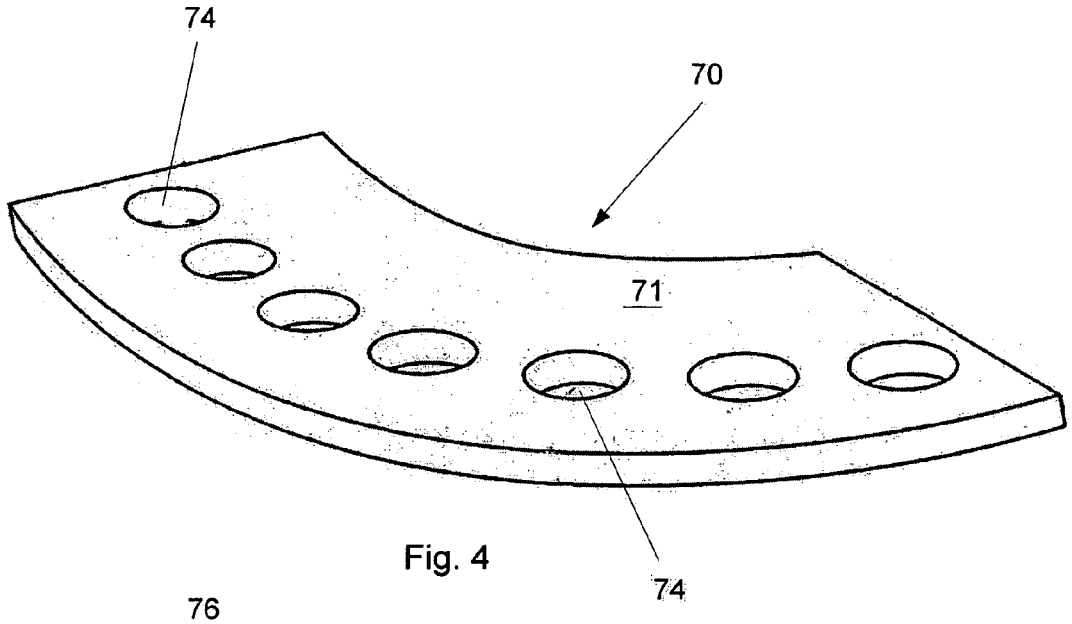
FIG. 4 is a front side view of the swing pad.

The base 20, best shown in FIGS. 2–3, has a front side 21, a rear side 23, a top surface 25, and includes a connector 22 positioned on the top surface 25. The connector 22 is used to connect the first arm 30 to the base 20. The front side 21 of the base 20 is preferably thicker than the rear side 23 causing the top surface 25 to be canted towards the rear surface 23. The base 20 also includes a position reference scale 24 which can be used to indicate desired feet position, ball position, swing extent, or other measurement relative to swing training. The base 20 is preferably made of a dense material, such as dense rubber, lead, or a plastic composite material, to provide greater stability and to help prevent tipping or movement of the swing training aid 10 during use.

The first arm 30 includes a proximal member 32, a distal member 34 and a locking mechanism 36. The length of the first arm 30 is adjustable, such as by having the outside diameter of the distal member 34 being slightly smaller than the inside diameter of the proximal member 32 to allow length adjustment of the first arm 30 by moving more or less of the length of the distal member 34 into and out-of the length of the proximal member 32. The locking mechanism 36 is used to lock the distal member 34 in place within the proximal member 32. The locking mechanism can be a twist-lock, a thumb screw, a spring loaded peg or any of various other locking mechanisms known in the art. The proximal end of the proximal member 32 connects to the connector 22 of the base 20 and the distal end of the distal member 34 connects to the first elbow 40.

The first adjustable elbow 40 includes a first leg 42, a second leg 44 and an adjustable connector 46 that connects the first leg 42 and the second leg 44. The adjustable connector 46 allows the angle between the first leg 42 and the second leg 44 to be adjusted. The first leg 42 of the first adjustable elbow 40 is connected to the proximal end of the first arm 30, and the second leg 44 of the first adjustable elbow 40 is connected to the second arm 50. Thus, by adjustment of the adjustable connector 46 the angle between the first arm 30 and the second arm 50 is changed.

The second arm 50 includes a proximal member 52, a distal member 54 and a locking mechanism 56. The length of the second arm 50 is adjustable, such as by having the outside diameter of the distal member 54 being slightly smaller than the inside diameter of the proximal member 52 to allow length adjustment of the second arm 50 by moving more or less of the length of the distal member 54 into and out-of the length of the proximal member 52. The locking mechanism 56 is used to lock the distal member 54 in place within the proximal member 52. The locking mechanism 56 can be a twist-lock, a thumb screw, a spring loaded peg or any of various other locking mechanisms known in the art. The proximal end of the proximal member 52 connects to the first elbow 40 and the distal end of the distal member 54 connects to the second adjustable elbow 60.

The connection of the second arm 50, the first elbow 40, the first arm 30 and the base 20 is such that the second arm 50 can be rotated about the base 20 and locked in a desired position. This can be done by allowing the adjustable connector 46 of the first elbow 40 to rotate freely about the first leg 42 of the first elbow 40; or by allowing the first leg 42 of the first elbow 40 to rotate freely about the distal member 34 of the first leg 30; or by allowing the proximal member 32 of the first leg 30 to freely rotate in the connector 22 of the base 20; or by some combination of the above or various other means known in the art.

The second adjustable elbow 60 includes a first leg 62, a second leg 64, an adjustable connector 66 and a pad connector 68. The adjustable connector 66 connects the first leg 62 and the second leg 64. The adjustable connector 66 allows the angle between the first leg 62 and the second leg 64 to be adjusted. The pad connector 68 is located at the distal end of the second leg 64. The first leg 62 is connected to the distal end of the second arm 50, and the pad connector 68 at the distal end of the second leg 64 is connected to the swing pad 70. Thus adjustment of the adjustable connector 66 adjusts the angle between the second arm 50 and the swing pad 70. The second elbow 60 can also be designed to allow the connector 68 to rotate about the first leg 42 which would allow the swing pad 70 to be rotated as well as pivoted.

Figure 5:
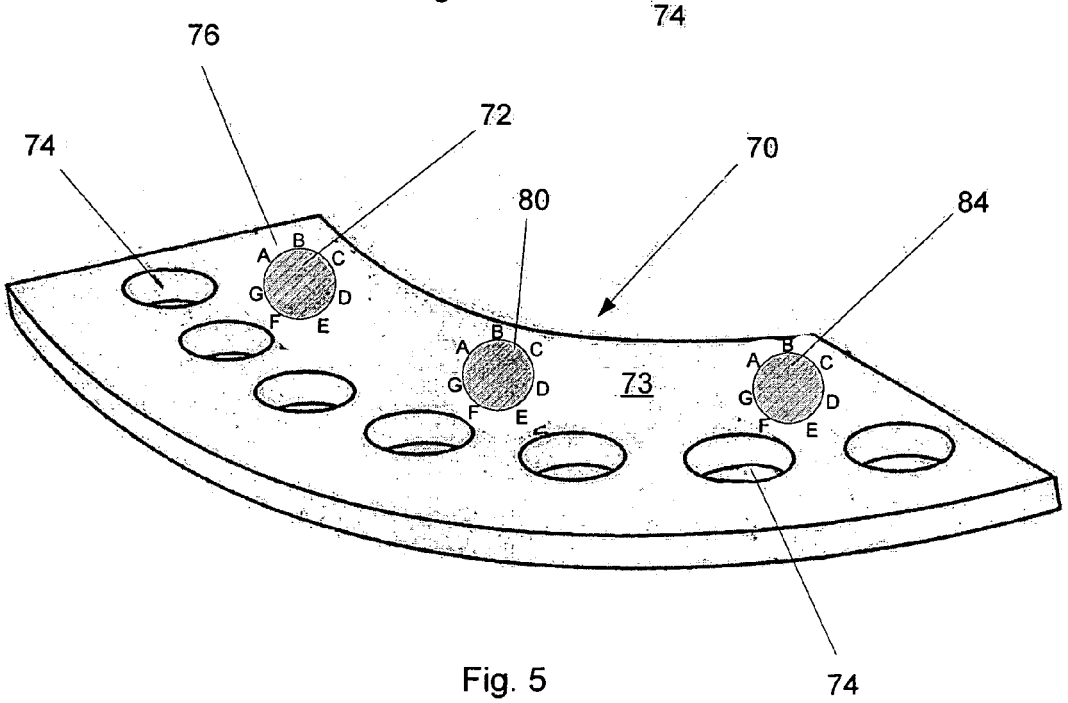
FIG. 5 is a rear side view of the swing pad.

The swing pad 70 is a generally flat, arc-shaped pad having a front side 71 and a back side 73, and that includes at least one attachment spot 72 and a plurality of wind apertures 74. The attachment spot 72 and the pad connector 68 of the second adjustable elbow 60 are made to easily attach and detach, such as through the use of Velcro, snaps, slots or other attachment mechanisms. The wind apertures 74 reduce the wind resistance caused by the pad 70 and thereby reduce the tendency of the swing training aid 10 to tip or move due to wind. In the preferred embodiment, the swing pad 70 includes multiple swing attachment spots 72 for use in different aspects of the sport. For example in golf swing training, the swing pad 70 could have the attachment spot 72 located left of center for right-handed full swing training, and include a second central attachment spot 80 for chipping or putting training, and a third attachment spot 84 right of center for left-handed full swing training, as shown in FIG. 5. In the preferred embodiment, a set of position markings 76 surrounds the swing attachment spot 72 to aid in proper orientation of the swing pad 70 on the connector 68 of the stand 12.

Figure 6B:
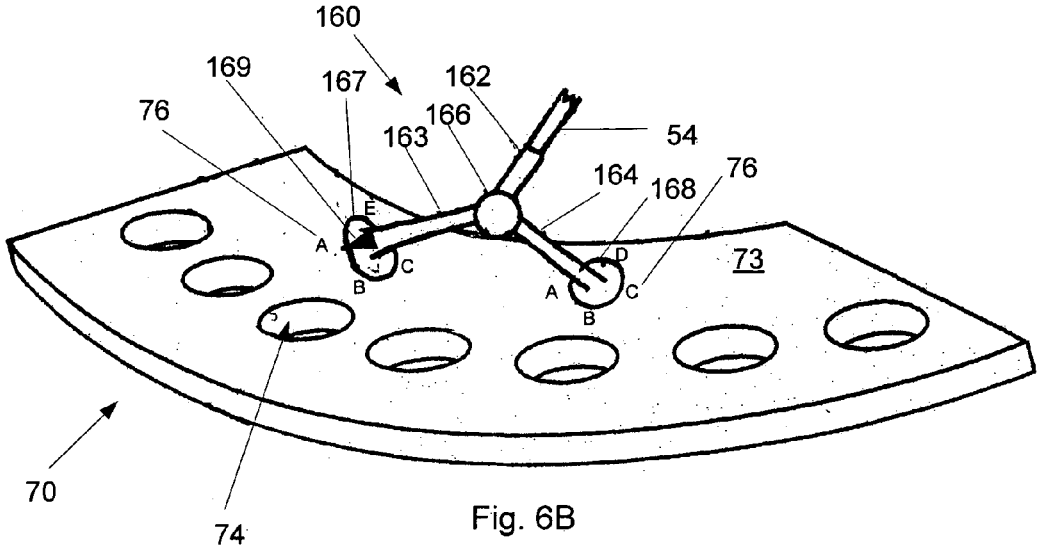
FIG. 6B is a close-up view of an alternative embodiment of the connection of the second elbow to the swing pad.
Figure 6A:
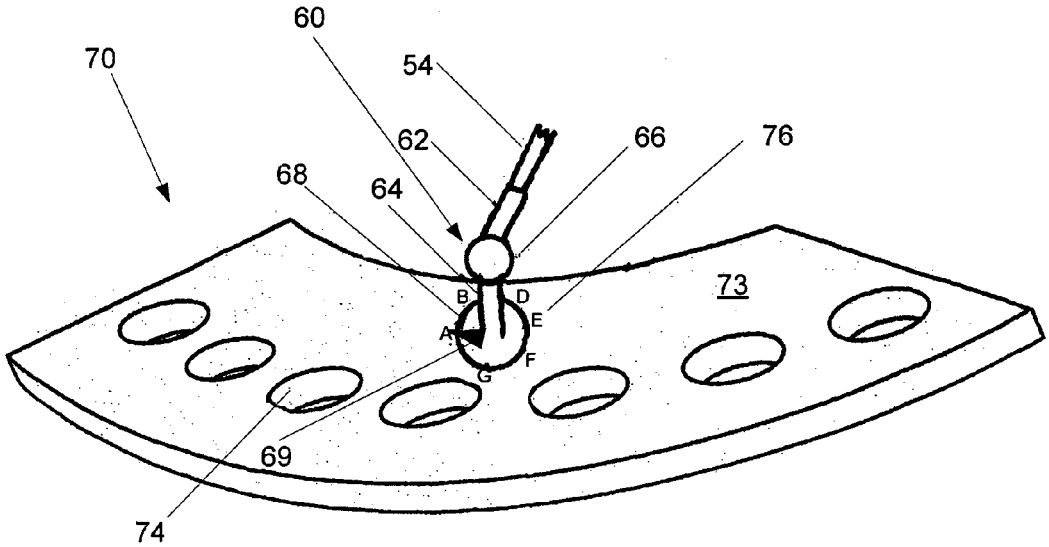
FIG. 6A is a close-up view of the connection of the second elbow to the swing pad.

FIG. 6A shows a close up view of the connection between the swing pad 70 and the stand 12. The swing pad 70 includes the swing attachment spot 72 which is covered by the connector 68 at the distal end of the second leg 64 of the second elbow 60. In the preferred embodiment, the connector 68 includes a reference alignment mark 69 which can point to a desired position shown by the set of position markings 76 surrounding the swing attachment 72 on the swing pad 70. In FIG. 6, the reference alignment mark 69 points to position "A" of the set of position markings 76 on the swing pad 70.

FIG. 6B shows a close up view of an alternative embodiment of the connection between the swing pad 70 and the stand 12, using a bifurcated second elbow 160. The bifurcated second adjustable elbow 160 includes a first leg 162, an adjustable connector 166, a right side bifurcated second leg 163, a right side pad connector 167, a left side bifurcated second leg 164, and a left side pad connector 168. The adjustable connector 166 connects the first leg 162 and both of the right-side and left-side bifurcated legs 163, 164. The adjustable connector 166 allows the angle between the first leg 162 and the right-side and left-side bifurcated legs 163, 164 to be adjusted. The right-side pad connector 167 is located at the distal end of the right side bifurcated second leg 163. The left-side pad connector 168 is located at the distal end of the left-side bifurcated second leg 164. The first leg 162 is connected to the distal end of the second arm 50, and the pad connectors 167, 168 are connected to the swing pad 70. Thus adjustment of the adjustable connector 166 adjusts the angle between the second arm 50 and the swing pad 70. The bifurcated second elbow 160 can also be designed to allow the pad connector 167, 168 to rotate about the first leg 42 which would allow the swing pad 70 to be rotated as well as pivoted. As shown in FIG. 6B, the swing pad 70 includes two swing attachment spots 72, the first of which is covered by the right side pad connector 167, and the second of which is covered by the left side pad connector 168 of the bifurcated second elbow 160. It is preferred that at least one of the pad connectors, in this case the right side pad connector 167, includes a reference alignment mark 169 which can point to a desired position shown by the set of position markings 76 surrounding the swing attachment spots 72 on the swing pad 70. In FIG. 6B, the reference alignment mark 69 points to position "A" of the set of position markings 76 on the swing pad 70. Having two pad connectors 167, 168 adds to the stability of the swing pad 70 on the stand 12.

Another alternative for the connection between the swing pad 70 and the stand 12 using a bifurcated second elbow 160 can be seen by a slight variation of what is shown in FIGS. 6A and 6B. A separate bifurcated leg assembly could be used that has a right side bifurcated second leg 163, a right side pad connector 167, a left side bifurcated second leg 164, and a left side pad connector 168. The vertex of the bifurcated legs 163, 164 could include an attachment mechanism that attaches to the second leg 64 of the second elbow 60. Thus, the second elbow 60 shown in FIG. 6A with the bifurcated legs 163, 164 having the associated pad connectors 167, 168 would attach to two attachment spots 72 of the swing pad 70 as shown in FIG. 6B.

The adjustability of the swing training aid 10 makes it a valuable training device in various aspects of a desired sport. Several ways it can be used in the sport of golf will be explained below, but it will be appreciated that the swing training aid can be used in many other sports and many other ways as well.

FIG. 1 shows the swing training aid 10 being used as a reference for arm and shoulder position in the full swing of a right-handed golfer. The first arm 30 is extended to put the first elbow 40 at a desired height. The second arm 50 is extended to place the swing pad 70 away from the base 20. The first elbow 40 is adjusted to place the swing pad 70 at the desired height to work on the golfer's arm and shoulder movement. The connector 68 of the second elbow 60 is attached to the attachment spot 72 that is right of center to have more of the swing pad 70 defining the desired back swing path. The second elbow 60 is adjusted to put the swing pad 70 in the desired swing plane. The right-handed golfer can then practice a full swing with the swing pad 70 acting as a reference for his arm and shoulder movement and, if desired, a ball can be placed in front of the base 20 for the golfer to hit during these practice swings.

Figure 7:
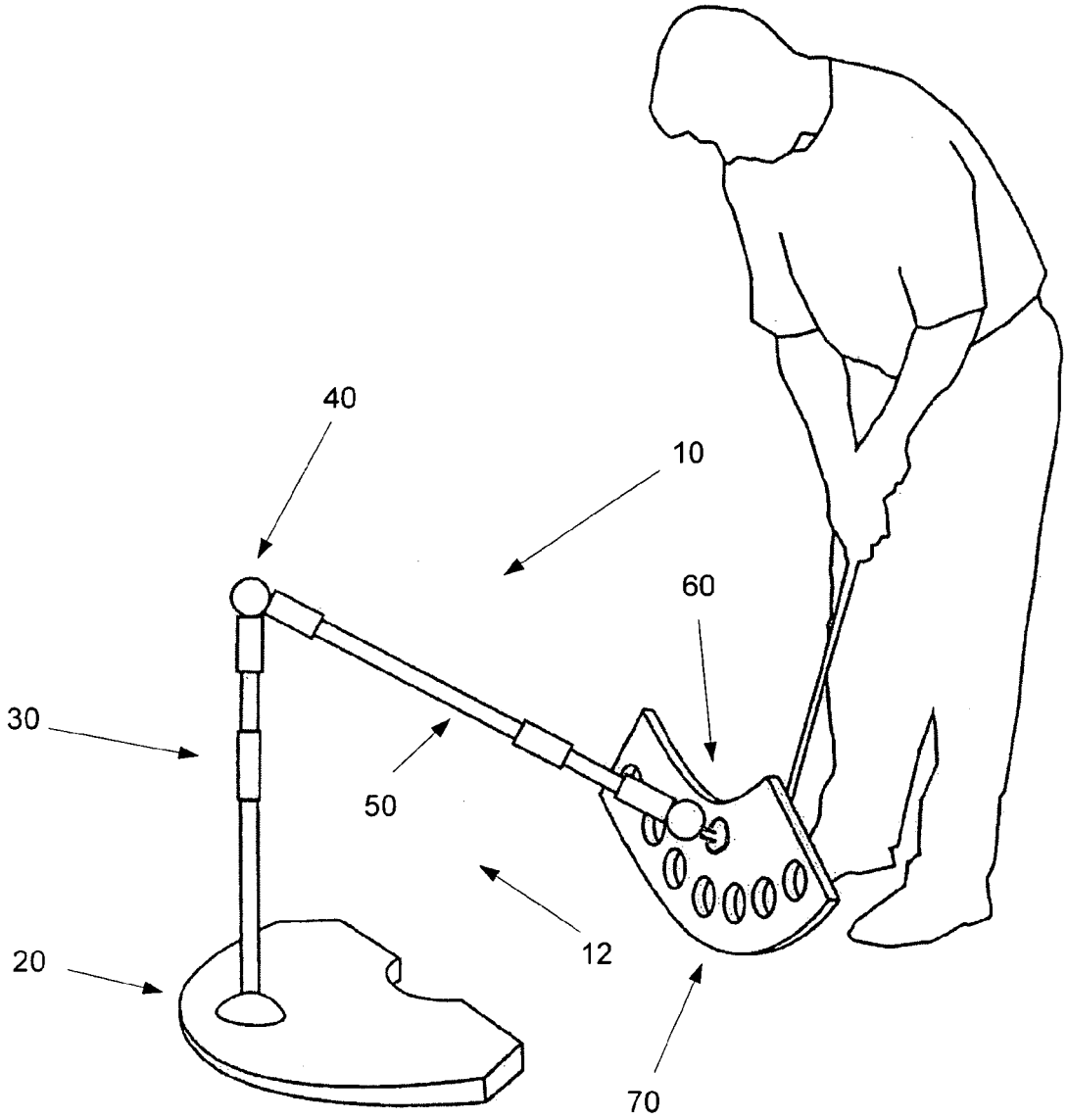
FIG. 7 is a schematic view of the swing training aid adjusted for putting training in golf.

FIG. 7 shows the swing training aid 10 being used as a reference for club movement in putting of a right-handed or left-handed golfer. The first arm 30 is extended to put the first elbow 40 at a desired height. The second arm 50 is extended to place the swing pad 70 away from the base 20. The first elbow 40 is adjusted to place the swing pad 70 at ground level to work on the golfer's club movement. The connector 68 of the second elbow 60 is attached to the attachment spot 72 that is at the center of the swing pad 70. The second elbow 60 is adjusted to put the swing pad 70 in the desired swing plane. The golfer can then practice putting with the swing pad 70 by moving the toe of his putter along the swing pad 70 and, if desired, a ball can be placed in front of the swing pad 70 for the golfer to hit during these practice putts.

Figure 8:
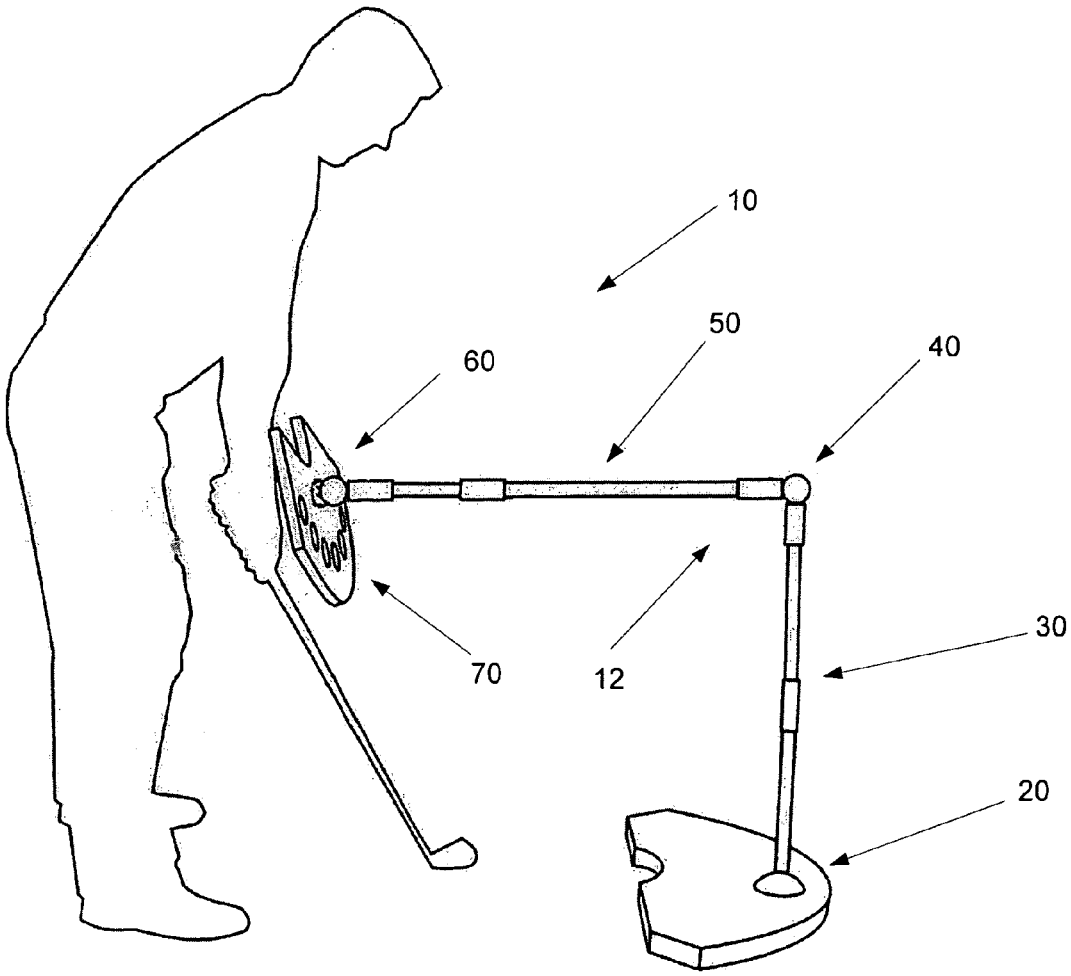
FIG. 8 is a schematic view of a swing training aid adjusted for partial-swing or chip shot training in golf.

FIG. 8 shows the swing training aid 10 being used as a reference for hand position in a half-swing or short chip swing of a right-handed or left handed golfer. The first arm 30 is extended to put the first elbow 40 at a desired height. The second arm 50 is extended to place the swing pad 70 away from the base 20. The first elbow 40 is adjusted to place the swing pad 70 at the desired height to work on the golfer's hand movement. The connector 68 of the second elbow 60 is attached to the attachment spot 72 near the center of the swing pad 70. The second elbow 60 is adjusted to put the swing pad 70 in the desired swing plane. The golfer can then practice a swing with the swing pad 70 acting as a reference for his hand movement and, if desired, a ball can be placed in front of the base 20 for the golfer to hit during these practice swings.

Figure 9:
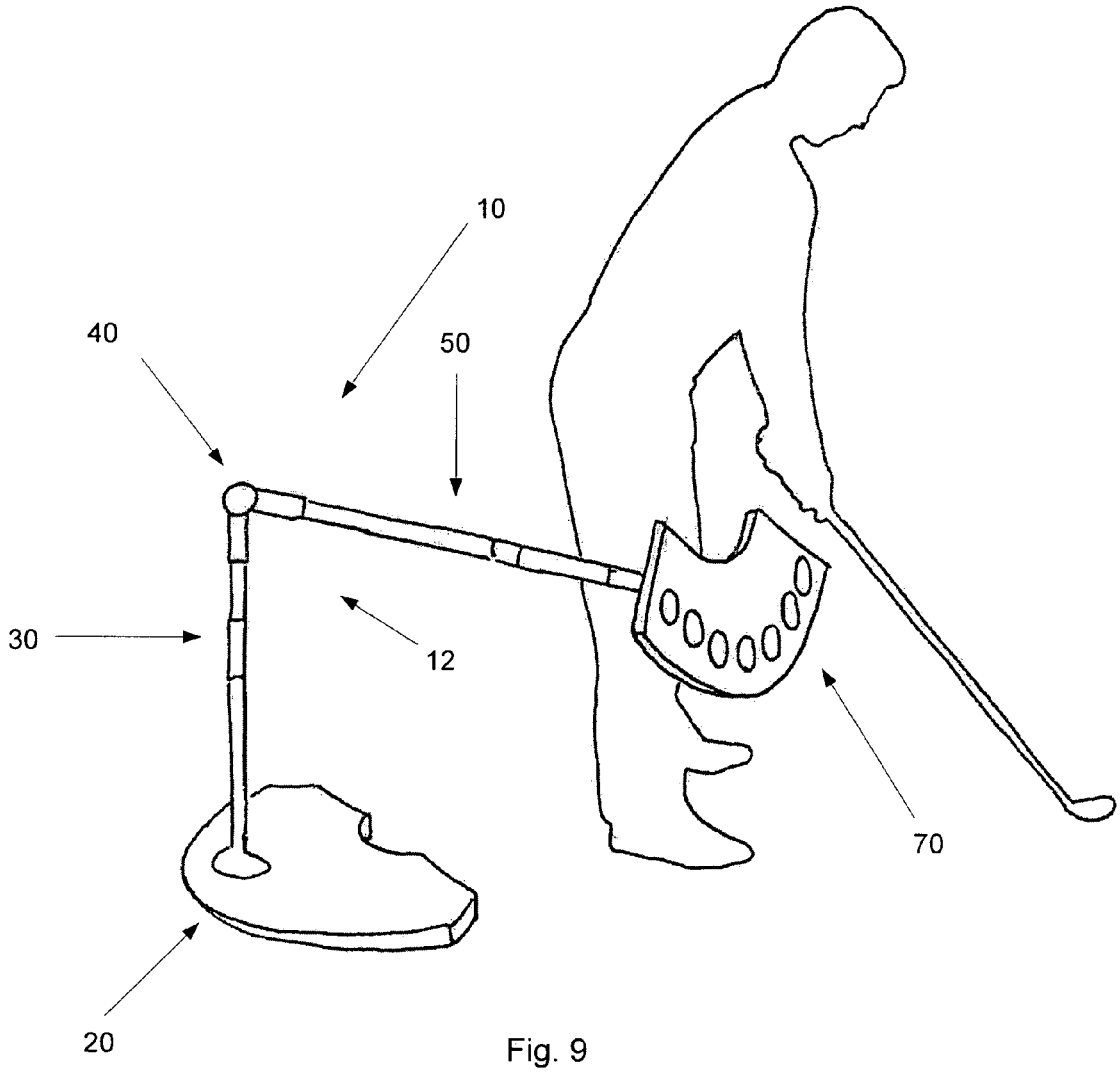
FIG. 9 is a schematic view of the swing training aid adjusted for helping the golfer maintain proper spine position and perform proper rotation during a swing.

FIG. 9 shows the swing training aid 10 being used behind the golfer as a reference for hand and club movement on the inside of the golfer's swing. The base 20 is placed behind the golfer. The first arm 30 is extended to put the first elbow 40 at a desired height. The second arm 50 is extended to place the swing pad 70 away from the base 20 inside the desired swing plane for the golfer's hands and club. The first elbow 40 is adjusted to place the swing pad 70 at the desired height to work on the golfer's hand and club movement. The connector 68 of the second elbow 60 is attached to the desired attachment spot 72 so the swing pad 70 defines the desired back swing path. The second elbow 60 is adjusted to put the swing pad 70 in the desired swing plane. The golfer can then practice a swing with the swing pad 70 acting as a reference for the inside of his hand and club movement during a swing and, if desired, a ball can be placed in front of the golfer to be hit during these practice swings.

Figure 10:
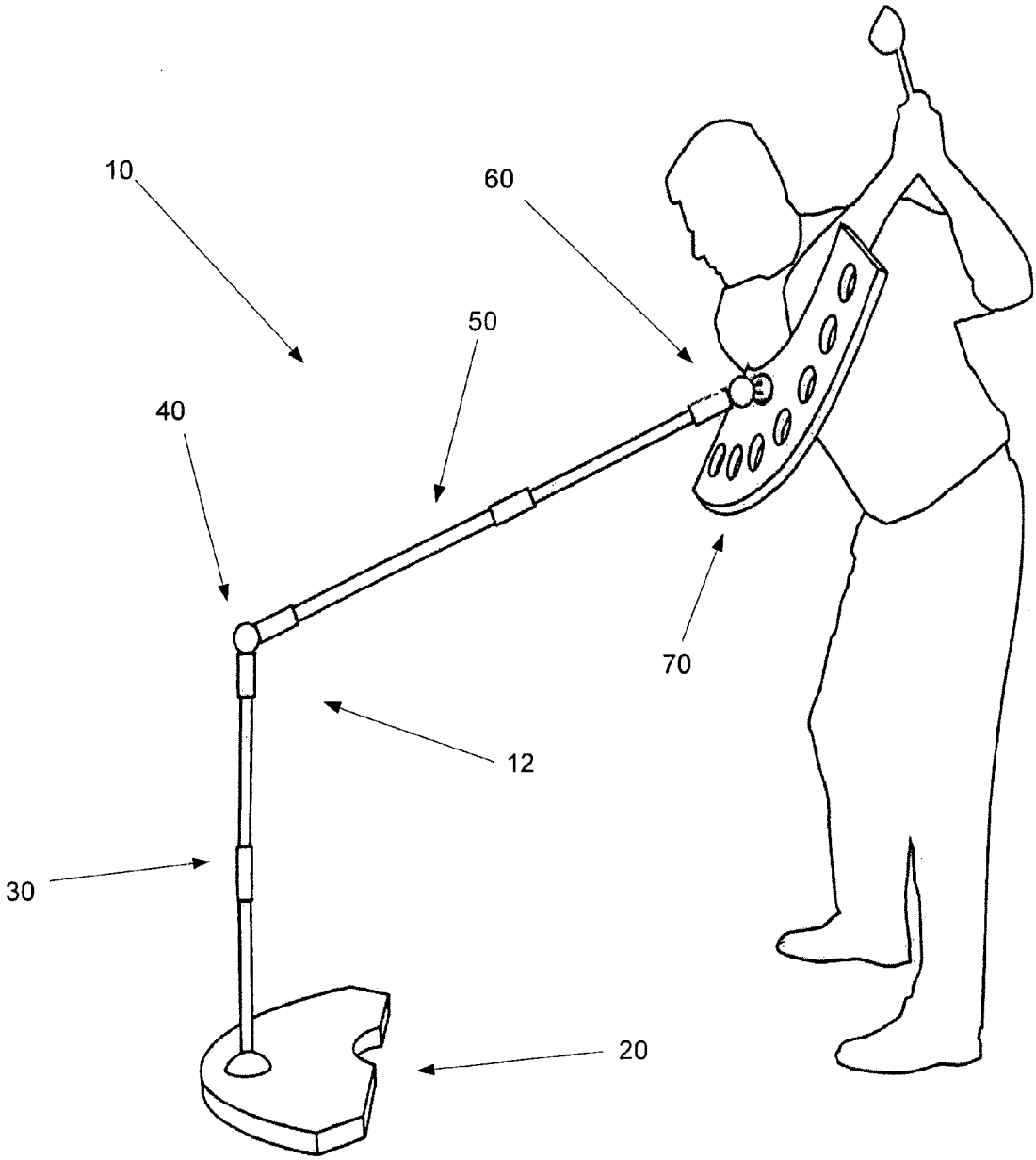
FIG. 10 is a schematic view of the swing training aid positioned at arm level for a left-handed golfer's full swing.

FIG. 10 shows the swing training aid 10 being used as a reference for arm and shoulder position in the full swing of a left-handed golfer. The first arm 30 is extended to put the first elbow 40 at a desired height. The second arm 50 is extended to place the swing pad 70 away from the base 20. The first elbow 40 is adjusted to place the swing pad 70 at the desired height to work on the golfer's arm and shoulder movement. The connector 68 of the second elbow 60 is attached to the attachment spot 72 that is left of center to have more of the swing pad 70 defining the desired back swing path for a left-handed golfer. The second elbow 60 is adjusted to put the swing pad 70 in the desired swing plane. The left-handed golfer can then practice a full swing with the swing pad 70 acting as a reference for his arm and shoulder movement and, if desired, a ball can be placed in front of the base 20 for the golfer to hit during these practice swings.

As explained above, the swing training aid 10 can be adjusted to be a reference for a desired swing path for various aspects of the swing of both left and right handed golfers, and on both the inside and outside of the golfer's swing. The height of the swing pad 70 can be adjusted to shoulder height, arm height, hand height, club face height (ground level) or virtually any other desired position to act as a reference plane for the desired swing path. The swing training aid 10 can be adjusted to any of these positions regardless of the golfer's height, whether they are extremely tall or very small. The position of the swing pad 70 on the stand 12 can be adjusted by using different attachment spots 72 to allow the swing pad 70 to show more of the back swing or follow through of the desired swing path. In addition, the swing training aid 10 can be used in other ways to improve the athletes swing including some examples explained below.

Figure 11:
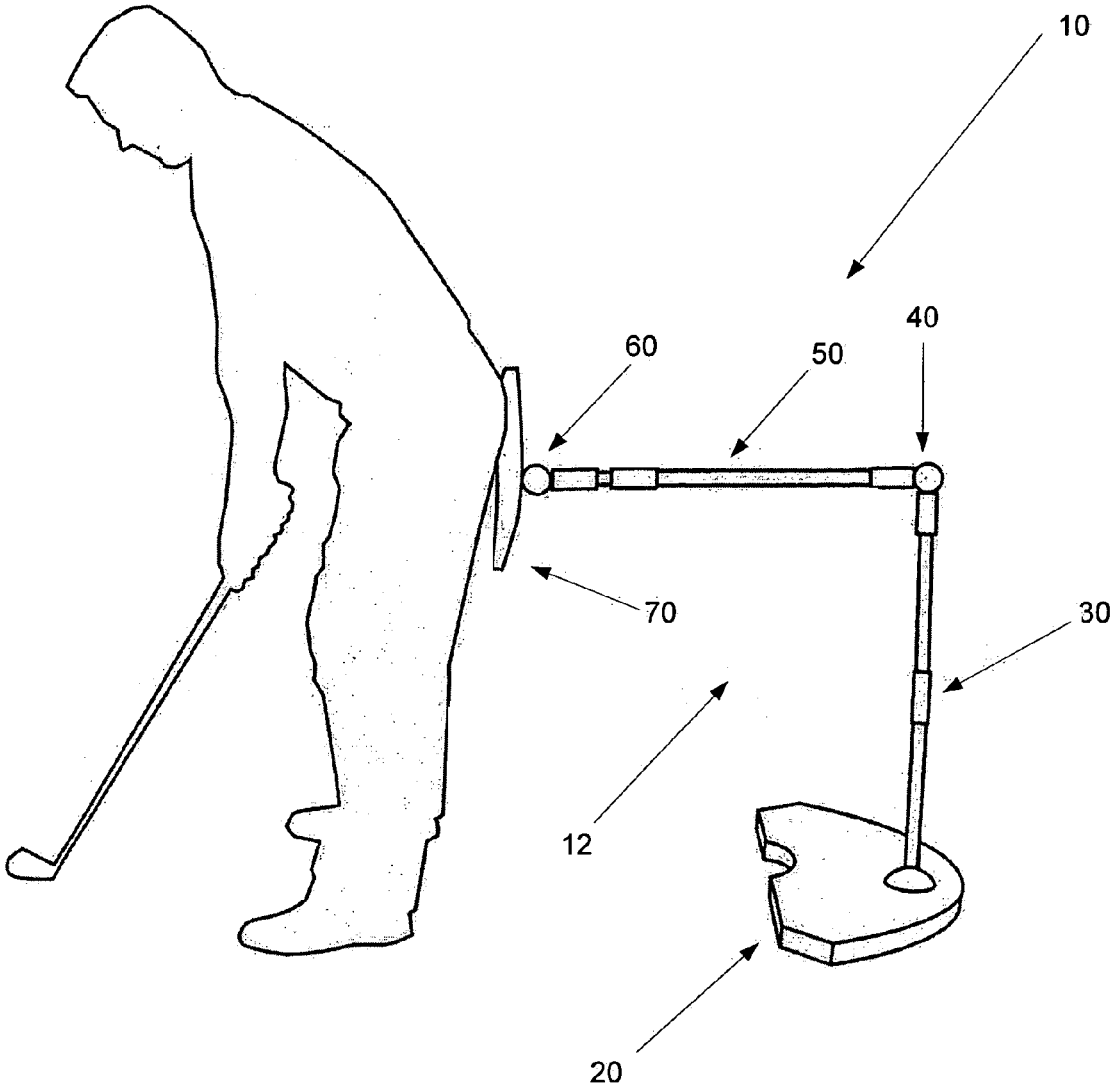
FIG. 11 is a schematic view of the swing training aid adjusted for helping the golfer maintain proper body position during a swing.

FIG. 11 shows the swing training aid 10 positioned against the golfer's buttocks to help the golfer maintain the desired body position during the swing. The base 20 is positioned behind the golfer. The first arm 30 is extended to put the first elbow 40 at a desired height. The second arm 50 is extended to place the swing pad 70 away from the base 20. The first elbow 40 is adjusted to place the swing pad 70 at the height of the golfer's buttocks. The connector 68 of the second elbow 60 is attached to the attachment spot 72 near the center of the swing pad 70. The second elbow 60 is adjusted to put the swing pad 70 at the desired angle. The golfer can then practice swinging with the swing pad 70 acting as a reference for his body to maintain the desired position. The golfer could also hit balls during these practice swings.

Figure 12:
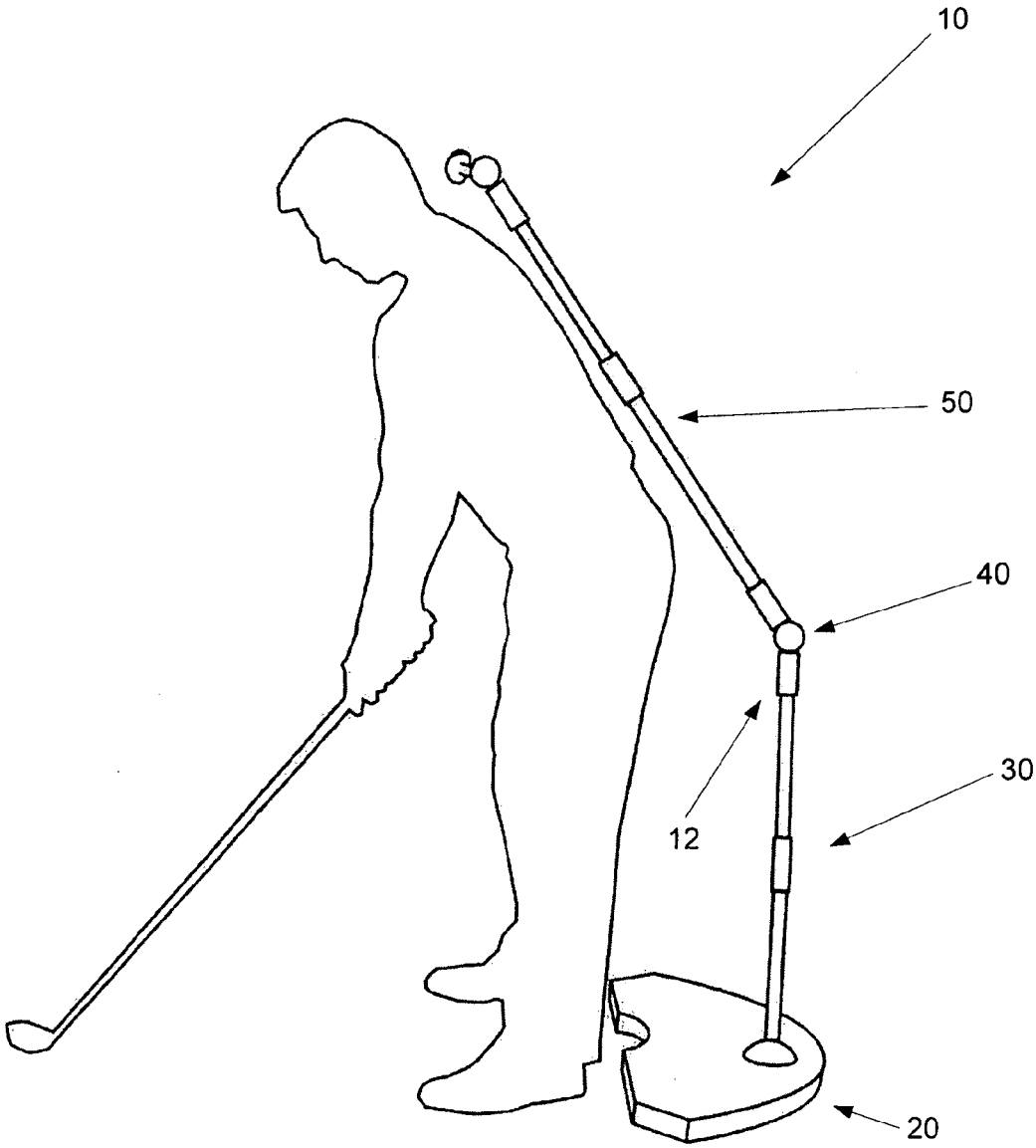
FIG. 12 is a schematic view of the swing training aid adjusted for helping the golfer maintain proper spine position and perform proper rotation during a swing.

FIG. 12 shows the swing training aid 10 positioned adjacent to the golfer's spine to help the golfer perform the desired rotation during the swing. The base 20 is positioned behind the golfer. The first arm 30 is extended to put the first elbow 40 at a desired height. The second arm 50 is extended to extend along the length of the golfer's spine. The first elbow 40 is adjusted to place the second arm 50 adjacent to the golfer's spine. For this exercise, the swing pad 70 is not needed. The golfer can then practice swinging with the second arm 50 acting as a reference for his body's rotation during the swing. The golfer could also hit balls during these practice swings.

Figure 13:
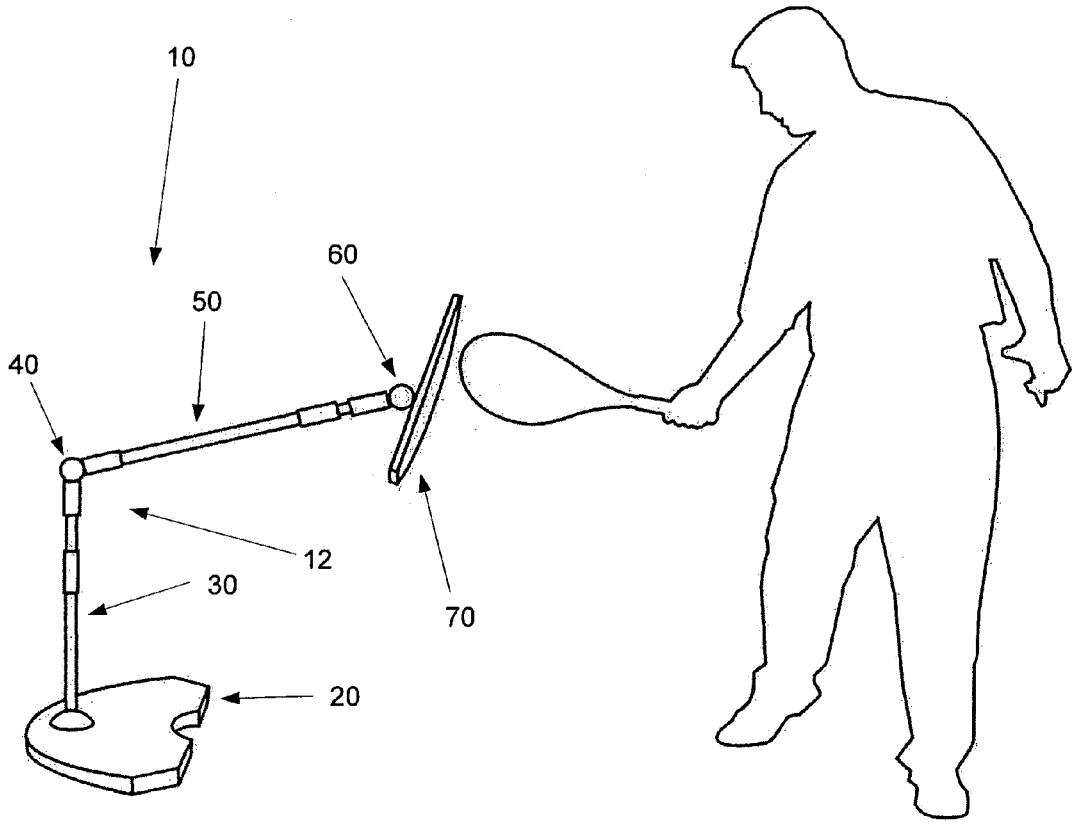
FIG. 13 is a schematic view of the swing training aid adjusted for racquet movement in tennis swing training.

The swing training aid 10 can also be used in other sports besides golf. For example, FIG. 13 shows the swing training aid 10 being used for tennis. The swing training aid 10 is positioned in front of the tennis player as a reference for the desired racquet path during the swing. The first arm 30 is extended to put the first elbow 40 at a desired height. The second arm 50 is extended to place the swing pad 70 a desired distance away from the base 20. The first elbow 40 is adjusted to place the swing pad 70 at the desired height to work on the tennis player's racquet movement. The connector 68 of the second elbow 60 is attached to the desired attachment spot 72 of the swing pad 70. The second elbow 60 is adjusted to put the swing pad 70 in the desired swing plane. The tennis player can then practice swinging the racquet with the swing pad 70 showing the desired racquet path and, if desired, a ball can be bounced or thrown in front of the swing pad 70 for the tennis player to hit during these practice swings.

Thw swing training aid 10 of the present invention is also easily moveable and portable. The swing training aid 10 can be broken down into four main parts: the base 20, the first arm 30 and first elbow 40, the second arm 50 and second elbow 60, and the swing pad 70. In the preferred embodiment, the base 20 is designed to have a shape generally similar to the swing pad 70 so that these two pieces can be stored together in minimal space. The first and second arms 30, 50 can also be collapsed to their shortest lengths to require minimal space. These pieces can then be stored in a travel bag with handles or shoulder strap for easy portability.

Having described the invention in detail, it will be appreciated that variations and modifications can exist within the scope and spirit of the invention as defined by the appended claims.

What is claimed is:

1. A swing training aid for training an athlete to perform a desired swing, said swing training aid comprising:

an adjustable stand comprising a first pad connector and a base, said base including a front side, a rear side and a top surface, said front side being thicker than said rear side such that said top surface tilts rearward; and a swing pad comprising a first attachment spot for matingly attaching said swing pad to said first pad connector of said adjustable stand;

wherein said adjustable stand can be adjusted to move said swing pad into a desired position.

2. Said swing training aid of claim 1, wherein said base further comprises a position reference scale.

3. A swing training aid for training an athlete to perform a desired swing with a piece of sports equipment, said swing training aid comprising:

an adjustable stand comprising a base, a first arm having a proximal end and a distal end, a second arm having a proximal end and a distal end, and a first pad connector, the proximal end of said first arm being coupled to said base, the distal end of said first arm being coupled to the proximal end of said second arm, and said first pad connector being coupled to the distal end of said second arm, said first arm being adjustable in length, a first adjustable elbow comprising a first leg, a second leg and an adjustable connector connecting said first leg to said second leg, wherein said first leg of said first adjustable elbow is connected to the distal end of said first arm, and said second leg of said first adjustable elbow is connected to the proximal end of said second arm, said first adjustable elbow allowing the angle between said first arm and said second arm to be varied, said first leg of said first adjustable elbow is being rotateable about said first arm; and a swing pad comprising a first attachment spot, said first attachment spot being coupled to said first pad connector of said adjustable stand, said swing pad defining a part of the desired swing with the piece of sports equipment;

wherein said adjustable stand can be adjusted to move said swing pad into a desired position.

4. Said swing training aid of claim 3, wherein said adjustable stand further comprises a second adjustable elbow comprising a first leg, a second leg and an adjustable connector connecting said first leg to said second leg, wherein said first leg of said second adjustable elbow is connected to the distal end of said second arm, and said second leg of said second adjustable elbow is connected to said swing pad, said second adjustable elbow allowing the angle between said second arm and said swing pad to be varied.

5. Said swing training aid of claim 4, wherein said swing pad is rotateable about said second arm.

6. Said swing training aid of claim 3, wherein said second arm is adjustable in length.

7. Said swing training aid of claim 3, wherein said second arm is rotateable about said base.

8. Said swing training aid of claim 3, wherein said swing pad is rotateable about said second arm.

9. Said swing training aid of claim 3, wherein said swing pad further comprises a plurality of wind apertures.

10. Said swing training aid of claim 3, wherein said swing pad further comprises a second attachment spot.

11. A swing training aid for training an athlete to perform a desired swing, said swing training aid comprising:

an adjustable stand comprising a base, a first arm having a proximal end and a distal end, a second arm having a proximal end and a distal end, and a first pad connector, the proximal end of said first arm being coupled to said base, the distal end of said first arm being coupled to the proximal end of said second arm, and said first pad connector being coupled to the distal end of said second arm; and a swing pad comprising a first attachment spot for matingly attaching said swing pad to said first pad connector of said adjustable stand;

wherein said adjustable stand can be adjusted to move said swing pad into a desired position; and wherein said adjustable stand further comprises a bifurcated adjustable elbow comprising a first leg, a right-side bifurcated leg, a left side bifurcated leg, an adjustable connector connecting said first leg to said right and left side bifurcated legs, and a second pad connector located at the distal end of said right-side bifurcated leg; said first pad connector of said adjustable stand being located at the distal end of said left-side bifurcated leg; and said swing pad further comprises a second attachment spot; said second pad connector being matingly attachable to said second attachment spot; wherein said first leg of said bifurcated adjustable elbow is connected to the distal end of said second arm, and said first pad connector of said left-side bifurcated leg is connectable to said first attachment spot of said swing pad, and said second pad connector of said right-side bifurcated leg is connectable to said second attachment spot of said swing pad such that said adjustable connector can be adjusted to vary the angle between said second arm and said swing pad.

12. A swing training aid for training an athlete to perform a desired swing, said swing training aid comprising:

an adjustable stand comprising a first pad connector; and a swing pad comprising a first attachment spot for matingly attaching said swing pad to said first pad connector of said adjustable stand;

wherein said adjustable stand can be adjusted to move said swing pad into a desired position; and wherein said swing pad further comprises position markings surrounding said first attachment spot; and said first pad connector further comprises a reference alignment mark; such that said reference alignment mark of said first pad connector can be aligned with said position markings to position said swing pad in a desired position relative to said adjustable stand.

13. A swing training aid for training an athlete to perform a desired swing, said swing training aid comprising:

a base having a top surface and comprising a connector, said connector being located on the top surface;

a first arm having a proximal end and a distal end, said proximal end being coupled to said connector of said base;

a second arm having a proximal end and a distal end;

a first adjustable elbow comprising a first leg, a second leg and an adjustable connector connecting said first leg to said second leg, said first leg being coupled to said first arm; said second leg being coupled to said second arm, said adjustable connector being adjustable to change the angle between said first arm and said second arm, and said second leg being rotateable about said base;

a swing pad comprising a plurality of attachment spots and a plurality of wind apertures; and a second adjustable elbow comprising a first leg, a second leg, a pad connector and an adjustable connector connecting said first leg to said second leg, said pad connector being attached to said second leg, said first leg being coupled to said second arm; said pad connector being coupled to one of said plurality of attachment spots of said swing pad, and said adjustable connector being adjustable to change the angle between said second arm and said swing pad.

14. Said swing training aid of claim 13 wherein said first arm comprises a proximal member, a distal member and a locking mechanism, said distal member being slideable into and out-of said proximal member to adjust the length of said first arm, and said locking mechanism being able to lock said first arm at a desired length.

15. Said swing training aid of claim 14 wherein said second arm comprises a proximal member, a distal member and a locking mechanism, said distal member being slideable into and out-of said proximal member to adjust the length of said second arm, and said locking mechanism being able to lock said second arm at a desired length.

16. Said swing training aid of claim 13, wherein said swing pad further comprises position markings surrounding each of said plurality of attachment spots; and said pad connector further comprises a reference alignment mark; such that said reference alignment mark of said pad connector can be aligned with said position markings to position said swing pad in a desired position relative to said adjustable stand.

* * * * *